US008051534B1

(12) United States Patent
Luca

(10) Patent No.: US 8,051,534 B1
(45) Date of Patent: Nov. 8, 2011

(54) PNEUMATIC DOOR CLOSER

(76) Inventor: Valentin Luca, Fairfield, CT (US)

( * ) Notice: Subject to any disclaimer, the term of this patent is extended or adjusted under 35 U.S.C. 154(b) by 0 days.

(21) Appl. No.: 11/810,375

(22) Filed: Jun. 5, 2007

(51) Int. Cl.
*E05F 3/02* (2006.01)

(52) U.S. Cl. ..... 16/66; 16/84

(58) Field of Classification Search ..... 16/66, 84; 188/282.8, 281
See application file for complete search history.

(56) References Cited

U.S. PATENT DOCUMENTS

| | | | | | |
|---|---|---|---|---|---|
| 2,647,774 | A | * | 8/1953 | Newberry, Jr. | 277/500 |
| 2,953,811 | A | * | 9/1960 | Hall | 16/66 |
| 3,059,269 | A | * | 10/1962 | Selinger et al. | 16/66 |
| 4,707,882 | A | * | 11/1987 | Watts | 16/66 |
| 4,776,440 | A | * | 10/1988 | Yamada et al. | 188/284 |
| 4,894,883 | A | * | 1/1990 | Fleischhauer | 16/66 |
| 5,157,806 | A | * | 10/1992 | Wartian | 16/66 |
| 5,220,706 | A | * | 6/1993 | Bivens | 16/66 |
| 5,630,248 | A | | 5/1997 | Luca | 16/71 |
| 5,832,562 | A | | 11/1998 | Luca | 16/71 |
| 5,842,255 | A | | 12/1998 | Luca | 16/51 |
| 6,871,381 | B1 | | 3/2005 | Luca | 16/52 |
| 6,976,288 | B1 | | 12/2005 | Luca | 16/66 |
| 6,976,289 | B1 | | 12/2005 | Luca | 16/76 |
| 7,055,319 | B1 | | 6/2006 | Luca | 60/475 |
| 7,111,359 | B1 | | 9/2006 | Luca | 16/66 |
| 7,219,391 | B1 | | 5/2007 | Luca | 16/50 |

* cited by examiner

*Primary Examiner* — Victor Batson
*Assistant Examiner* — Matthew Sullivan
(74) *Attorney, Agent, or Firm* — Fattibene and Fattibene LLC; Paul A. Fattibene

(57) ABSTRACT

A pneumatic door closer for effecting the closing of an associated door having a controlled rate of a closing motion that is generally uniform, smooth and safe in moving from an opened to closed position of an associated door. The door closer includes an elongated cylinder with a displaceable piston defining a vacuum chamber and a pressure chamber within the elongated cylinder wherein the piston is normally biased toward a door closing position by a suitable spring. A piston rod connected to the piston has its free end extending through a rod opening that includes an air impervious seal formed about the piston rod extending therethrough. Disposed in communication with the vacuum chamber is a breather arrangement for diminishing in a controlled manner the level of vacuum being created within the vacuum chamber during the closing stroke of the piston to control the resulting resistance forces acting on the piston such that the closing speed is essentially uniform throughout the closing stroke.

10 Claims, 11 Drawing Sheets

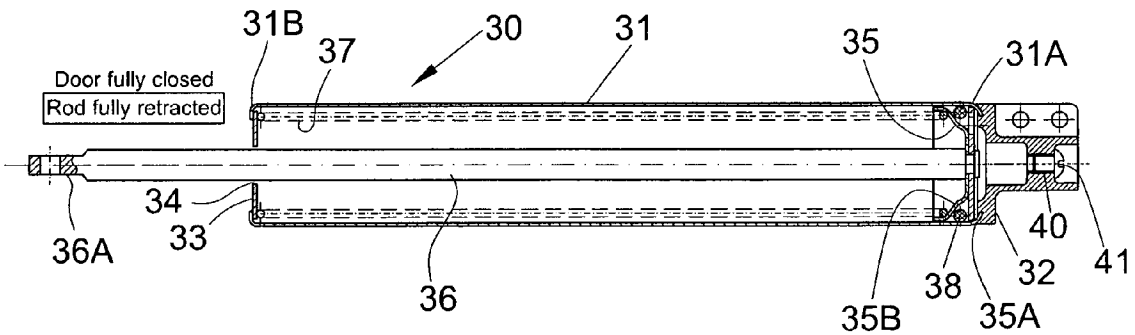
Fig. 2
PRIOR ART
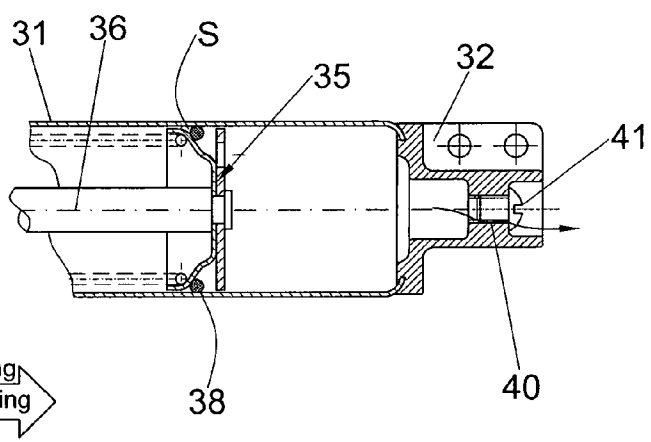
Fig. 2-B
PRIOR ART
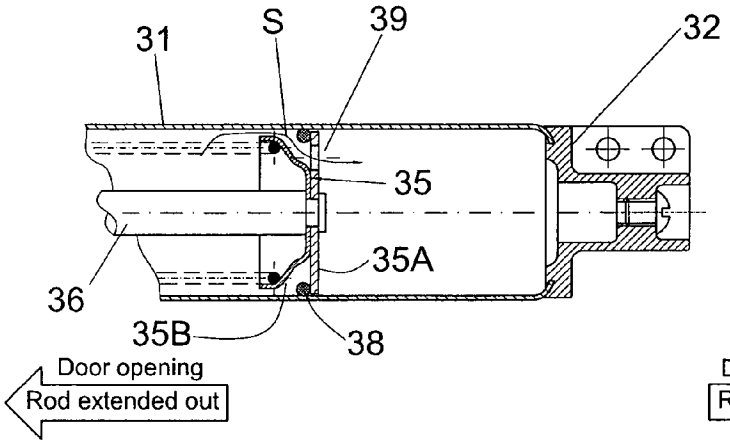
Fig. 2-A
PRIOR ART

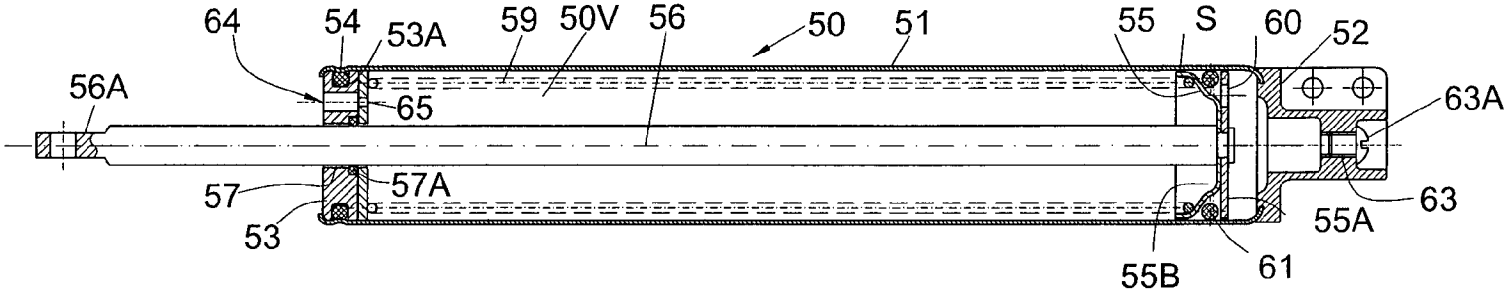
Fig. 3-A
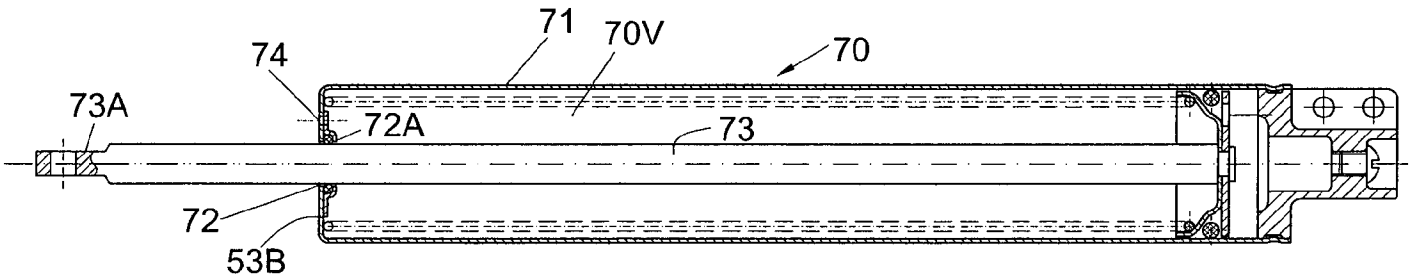
Fig. 3-B
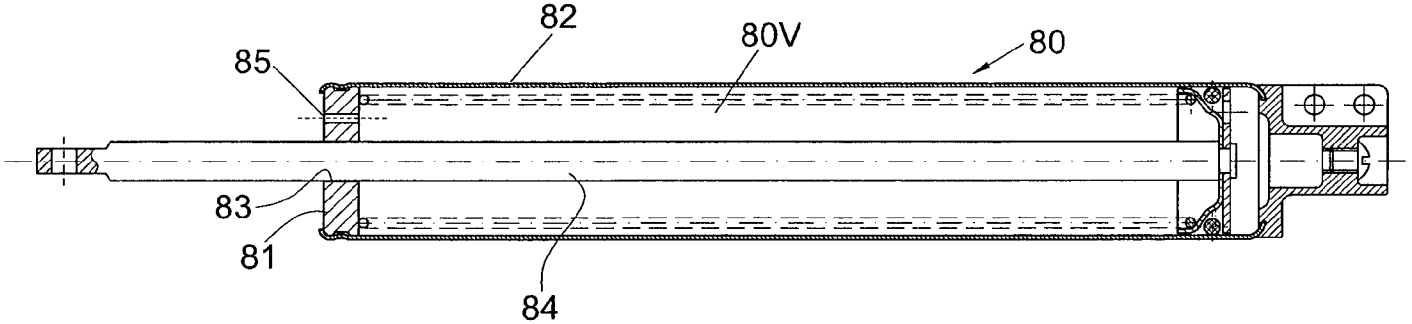
Fig. 3-C

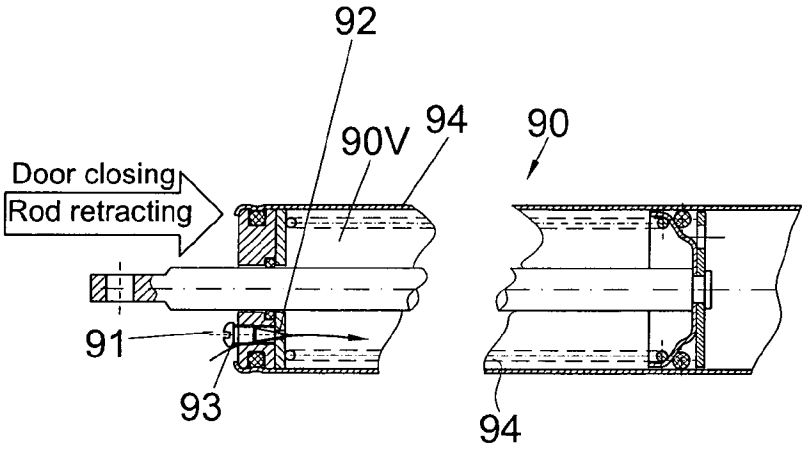
Fig. 4-B
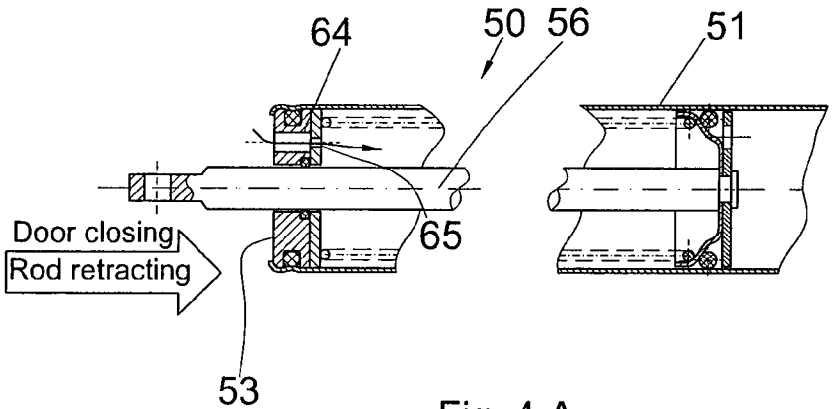
Fig. 4-A
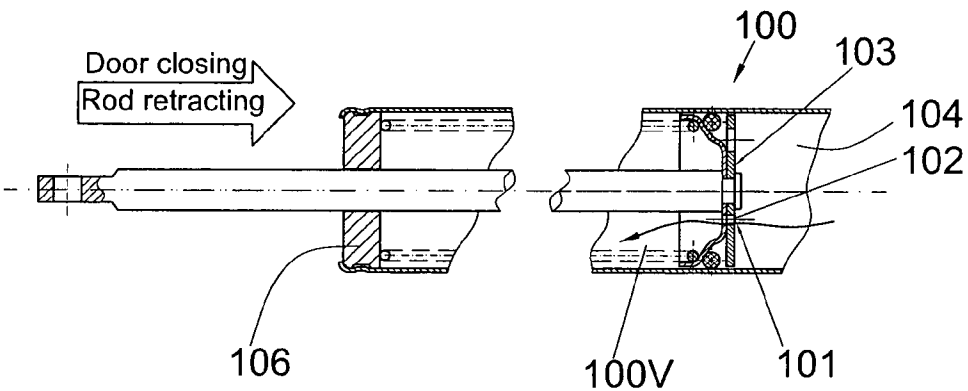
Fig. 4-C

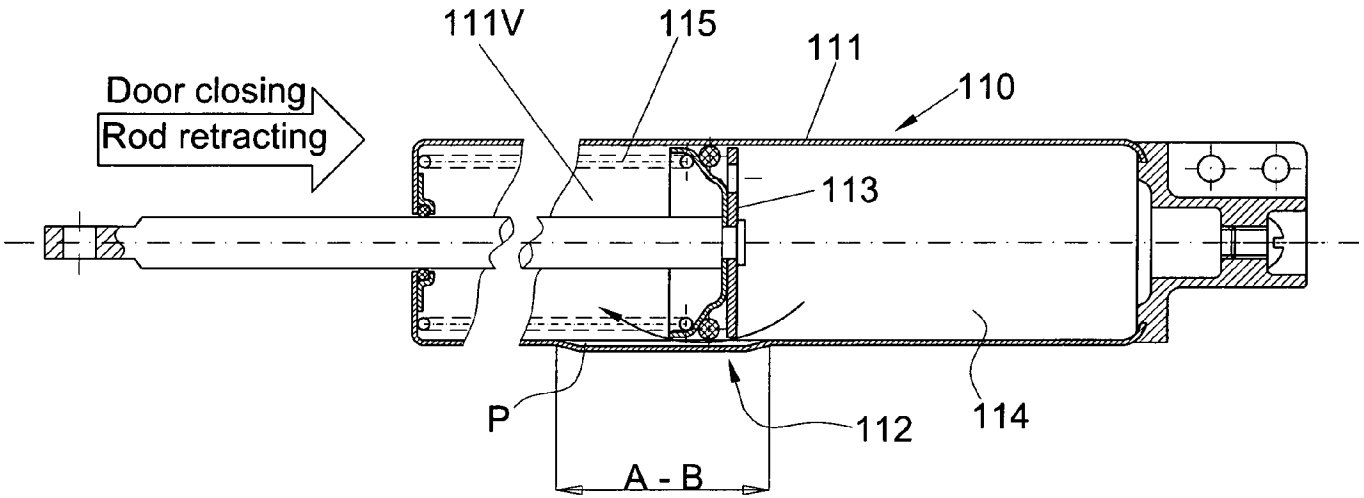
Fig. 4-D
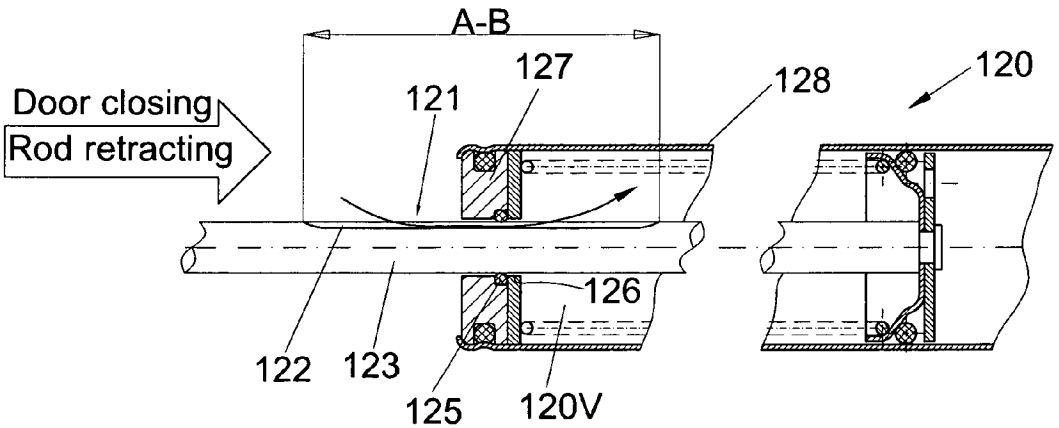
Fig. 4-E

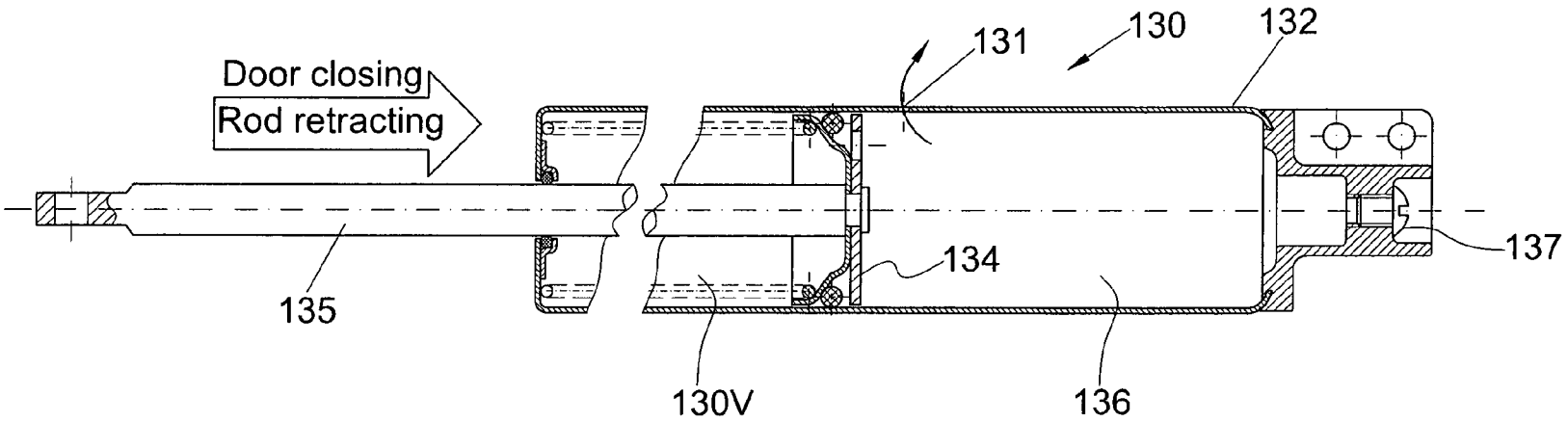
Fig. 4-F-1
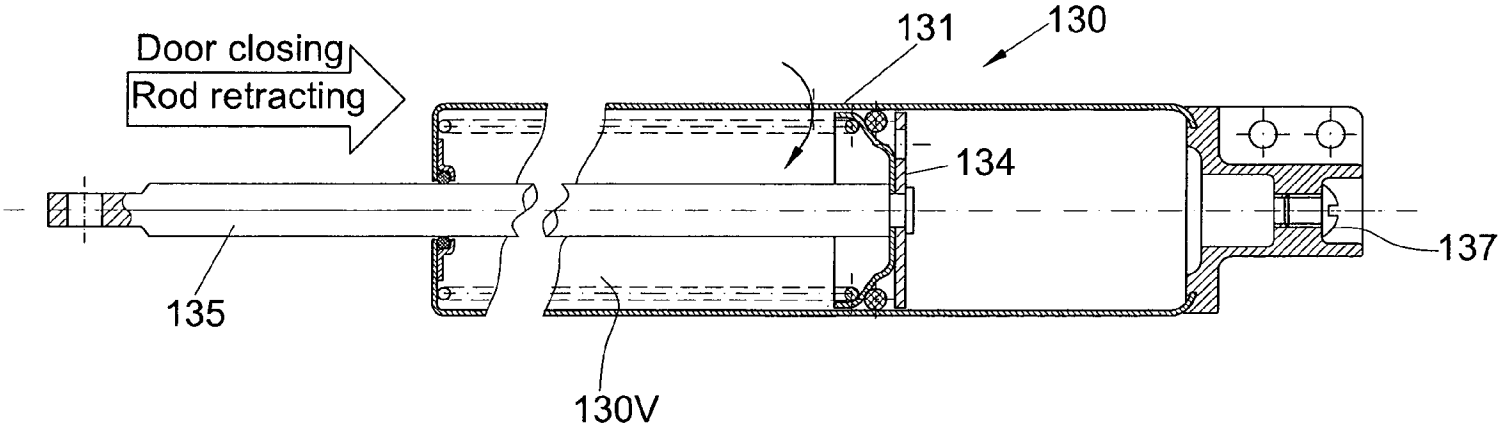
Fig. 4-F-2

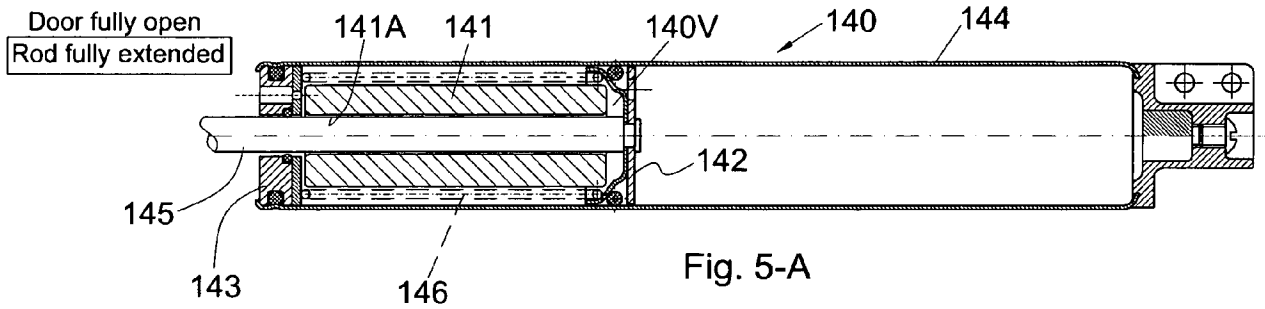
Fig. 5-A
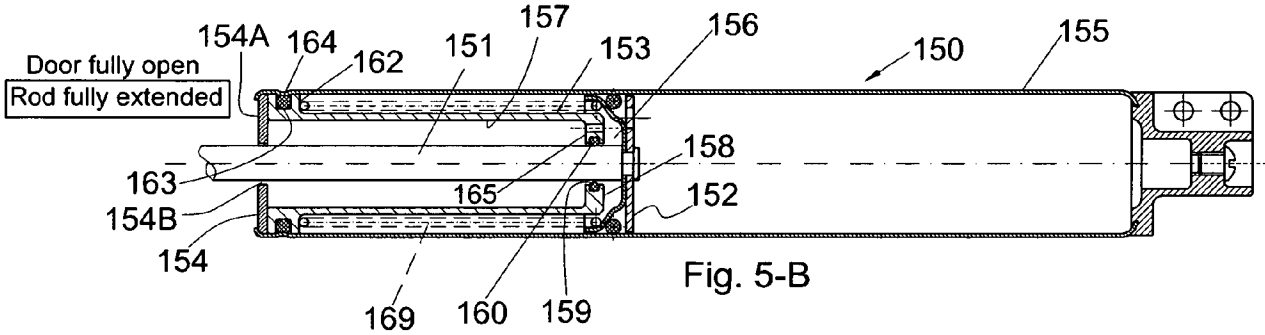
Fig. 5-B
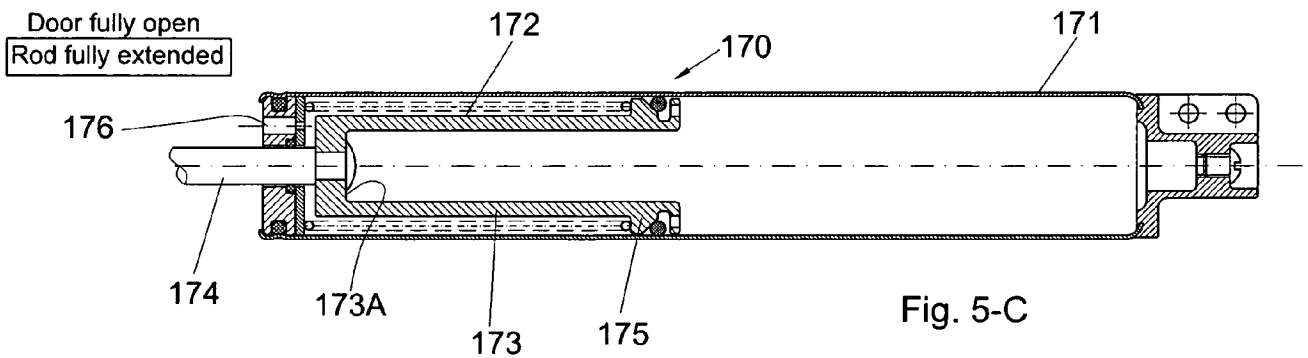
Fig. 5-C

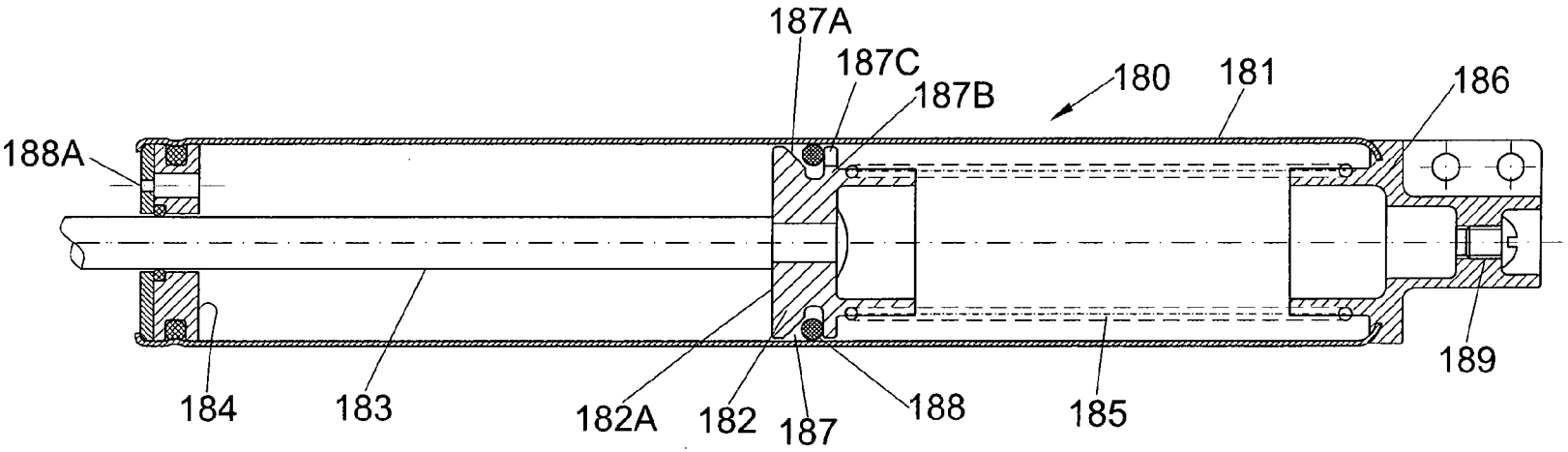
Fig. 6-A
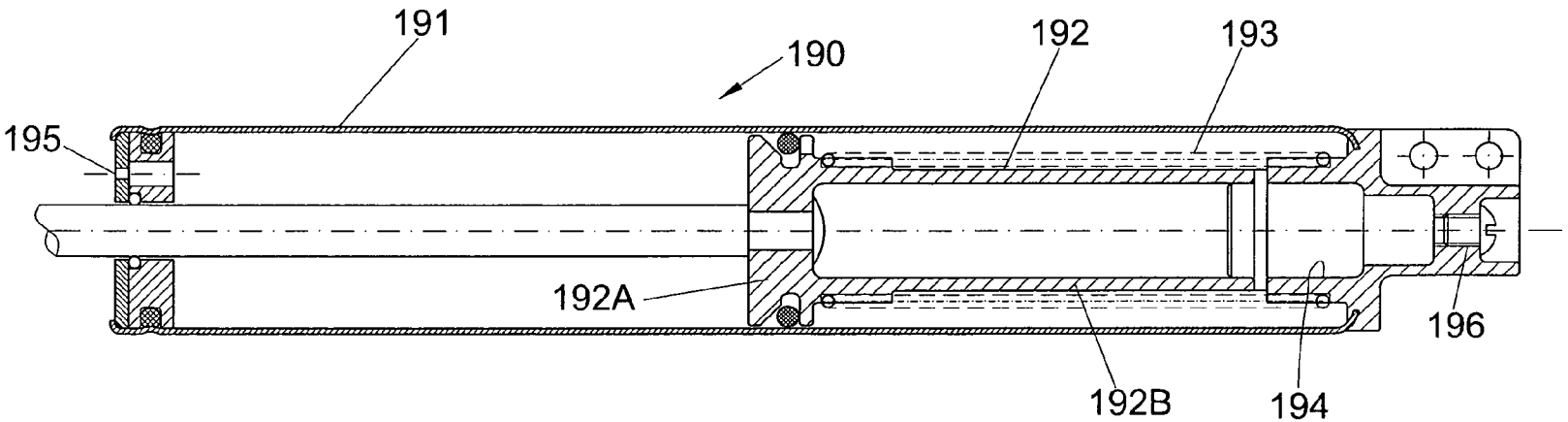
Fig. 6-B

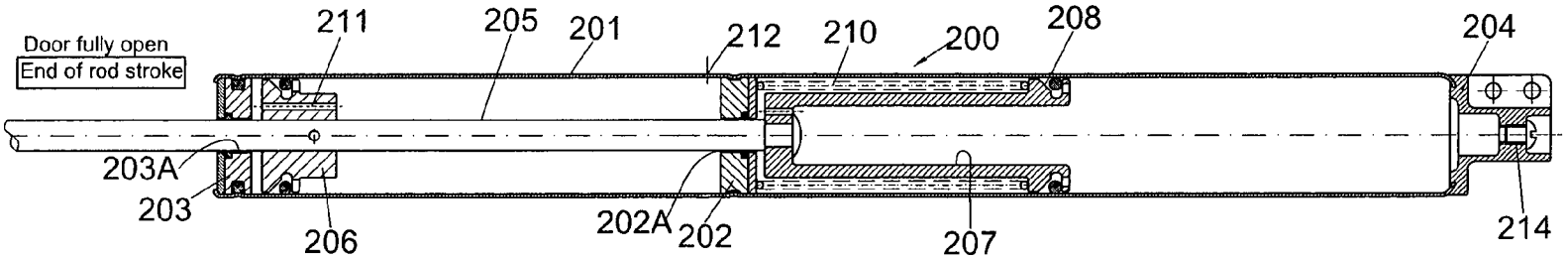
Fig. 7-A
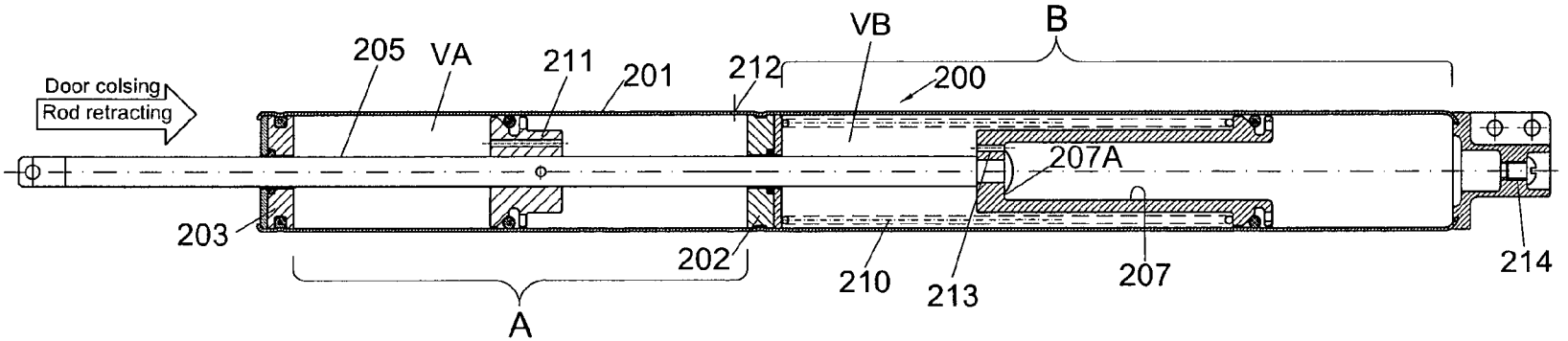
Fig. 7-B

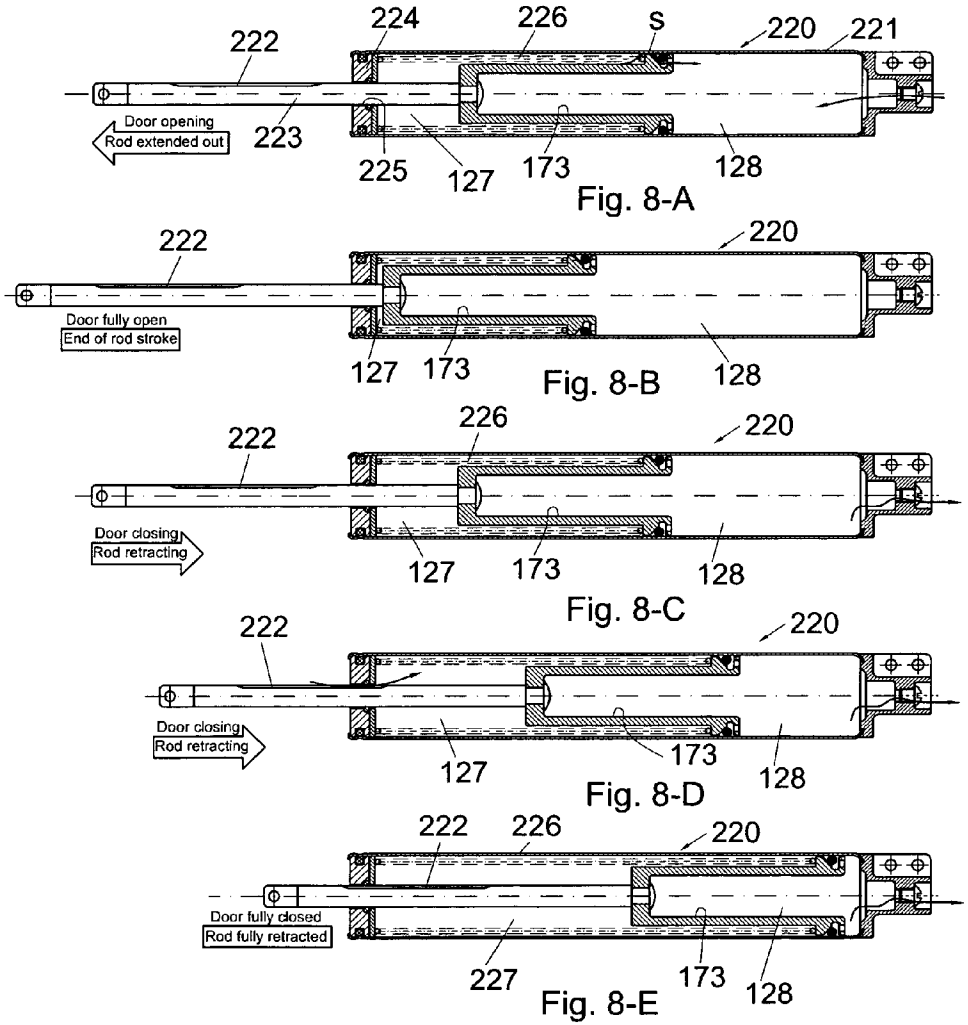
221
220
S
128
226
173
127
224
225
222
223
Door opening
Rod extended out
Fig. 8-A
220
128
173
127
222
Door fully open
End of rod stroke
Fig. 8-B
220
128
226
173
127
222
Door closing
Rod retracting
Fig. 8-C
220
128
173
127
222
Door closing
Rod retracting
Fig. 8-D
220
128
173
226
227
222
Door fully closed
Rod fully retracted
Fig. 8-E

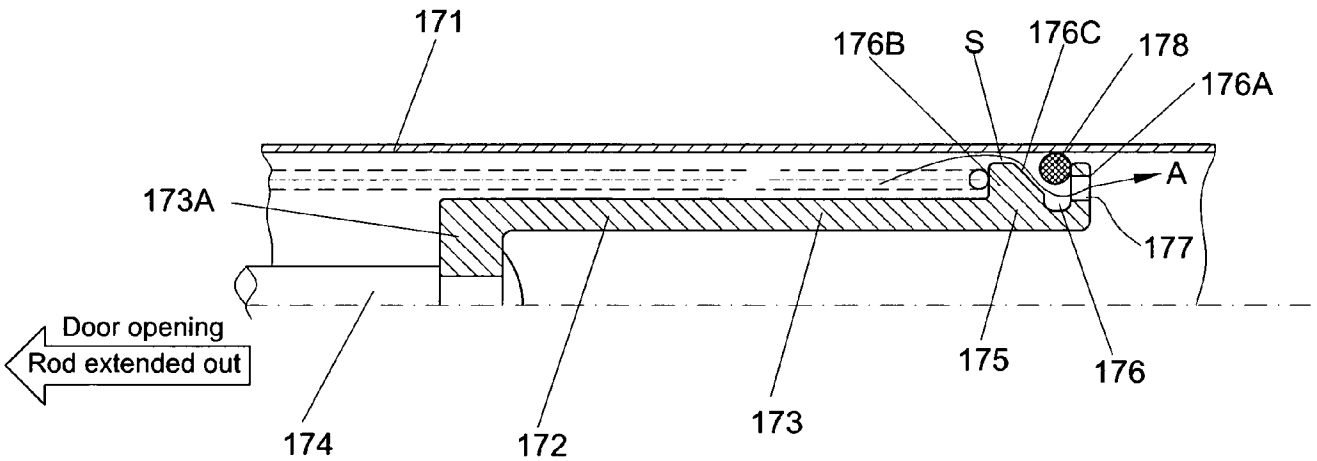
Fig. 8-A-1
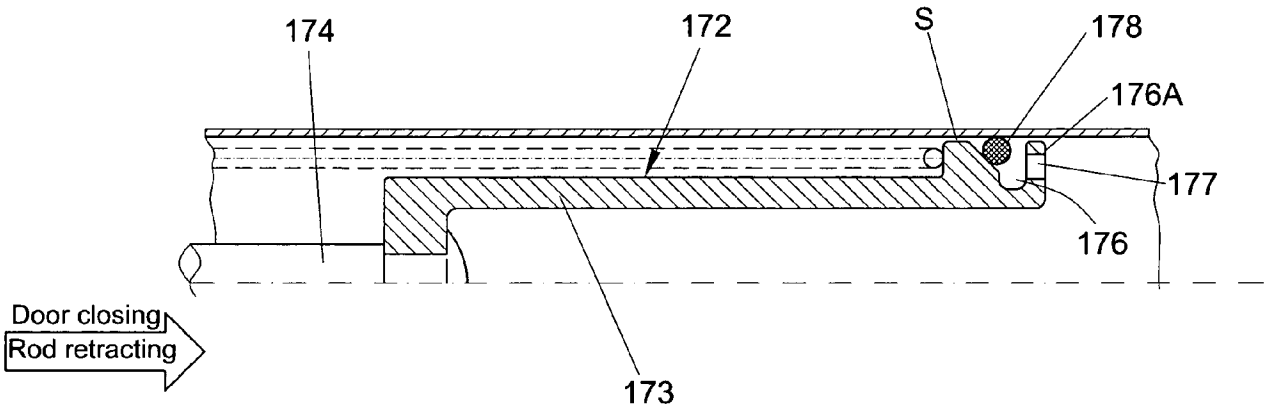
Fig. 8-C-1

PNEUMATIC DOOR CLOSER

FIELD OF THE INVENTION

This invention is directed to door closers, and more specifically to a pneumatic door closer having an improved arrangement for effecting the closing of a door associated therewith at a controlled rate of speed that is generally uniform, smooth and safe in moving from the opened to closed position of the associated door.

BACKGROUND OF THE INVENTION

Generally, the known pneumatic door closers include an elongated cylinder having a piston connected to a piston rod reciprocally displaceable within the cylinder, the piston and associated piston rod being normally biased by a spring toward the closed position of the door. With the free end of the piston rod extending beyond an end wall of the cylinder and the other end of the cylinder suitably connected between a door frame and the door, the opening of the door causes the piston to be rectilinearly displaced within the cylinder, whereby the spring is forcibly biased by the displacement of the piston within the cylinder as the piston rod is extended through the associated end wall of the cylinder. The force of the spring bias acting on the piston normally functions to return the door to the closed position as the door is released after the opening thereof. During the door closing motion of such known pneumatic door closers, the displaceable piston, under the bias of the spring, tends to compress the air medium in the chamber of the cylinder opposed to the piston rod so that the resultant air pressure acting on the piston tends to slow down the piston and thus the closing of the door.

However, it has been noted that a major inconvenience or disadvantage with such known pneumatic door closers is that after an associated opened door has been released for closing, the door initially closes at a relatively rapid closing speed for about two-thirds of the closing stroke of the piston or until such time that the air within the pressure chamber opposed to the piston rod has been sufficiently compressed to a level that can counterbalance the force of the spring and the inertia of the door so as to exert a sufficient amount of pressure on the piston to control or slow the rate of closing of the door during the final one third phase of the closing stroke so as to avoid any damage or banging of the door or injury to the user. It has been observed that such pneumatic door closers are able to achieve a reasonable controlled rate of closing only during the approximately last one third of the closing stroke of the piston. From a user's point of view, a door equipped with such known pneumatic door closers is not user friendly, as the initial high closing speed over the initial two thirds of the closing stroke can cause injury to an unsuspecting user and/or unnecessary damage or excessive banging of the door on closing.

While the foregoing noted problems may be avoided by utilizing hydraulic door closers which are able to achieve a more uniform or controlled closing speed due to the incompressibility of a liquid medium, such is not a practical solution as hydraulic closers are relatively more expensive and are also subject to other problems in the event of any loss or leakage of the hydraulic fluid.

SUMMARY OF THE INVENTION

An object of this invention is to provide a pneumatic door closer capable of functioning with a smooth, generally uniform and controlled closing speed analogous to that of a hydraulic door closer while maintaining the economic and reliability advantages of a pneumatic door closer.

Another object of this invention is to provide a pneumatic door closer with vacuum means by an arrangement for creating a vacuum to produce a pressure differential acting on the piston sufficient to slow the speed of closing during the initial phase of the closing stroke.

Another object of the invention is to provide a pneumatic door closer with a vacuum chamber opposite the pressure chamber, said vacuum chamber being realized by sealing means that allows the pressure in the vacuum chamber to drop substantially below the atmospheric pressure on the rod side of the piston to slow the rate of closing during the initial closing phase of the door.

Another object of the invention is to provide a pneumatic door closer whereby the chamber formed between one side of the piston and the end wall of a cylinder, through which the piston rod extends to function as a vacuum chamber so as to enhance the resistance force acting on the piston in a manner that uniformly controls or smoothes out the closing speed of the associated door throughout the closing stroke of the door closer.

Another object of this invention is to provide a pneumatic door closer having a displaceable piston disposed within a cylinder for defining a vacuum chamber on one side of the piston and a pressure chamber on the other side of the piston wherein an arrangement is associated with a vacuum control means for reducing the level of vacuum acting on the piston in a controlled way that ultimately results in a uniform, controlled closing motion.

Another object of the invention is to provide a pneumatic door closer having a displaceable piston within a cylinder to define a vacuum chamber opposing a pressure chamber wherein the vacuum chamber includes a volume displacer to enhance the pressure drop within the vacuum chamber during the closing stroke of the pneumatic door closer to increase the resultant resistance forces acting on the piston for controlling the closing speed in a generally uniform and smooth manner throughout the entire closing stroke of the door closer.

The foregoing objects, features and other advantages are attained by a pneumatic door closer having an elongated cylinder with opposed end walls and a displaceable piston reciprocally disposed within the elongated cylinder. A piston rod is connected to the piston wherein the free end of the piston rod projects outwardly through an air impervious sealed opening in the end wall of the cylinder. Disposed within the cylinder, e.g. on the rod side of the piston, is a spring such that one end thereof exerts a force on the piston and the other end of the spring exerts a force on the end wall of the cylinder. The arrangement is such that the free end of the piston rod and the opposed end of the cylinder are suitably connected between a door frame and the associated door by suitable brackets so that when the door is moved toward its opened position, the piston rod is extended outwardly of the cylinder. In doing so, the piston is displaced, causing the spring to be loaded so as to exert a spring bias on the piston for effecting the retraction of the piston rod and associated piston within the cylinder to effect the closing of the door upon the release of the door from its opened position. In one form of the invention, the spring acting on the piston may be a compression spring. In another form of the invention, the spring acting on the piston may be a tension spring.

In accordance with this invention, the piston is provided with a unidirectional valving arrangement that allows the air on the rod side of the piston to flow freely into the expanding chamber disposed on the other side of the piston as the piston rod is extended outwardly of the cylinder upon the opening of the associated door. When the piston rod retracts into the cylinder, as caused by the closing of the door, the piston valving arrangement prohibits any air from back flowing from the pressure side of the piston to the other or vacuum side of the piston. Thus, the retraction of the piston rod into the cylinder under the spring bias causes air pressure to build up on the pressure side of the piston to create a force that opposes the closing of the door to slow or retard the closing speed of the door, which occurs mostly during the final one third of the piston stroke.

To reduce the rate of closing over the initial two-thirds of the piston stroke so as to more uniformly control the rate of closing over the entire range of the piston stroke, the present invention provides a vacuum chamber between the piston and the end wall through which the piston rod extends with seals that renders that chamber essentially air tight. A breather arrangement associated with the vacuum chamber is provided for diminishing in a controlled way the level of vacuum being created within the vacuum chamber such that it ultimately results in a uniform closing motion. The system is so arranged such that vacuum is used mostly to slow the rate of closing during the initial portion of the piston closing stroke, i.e. until the air pressure being built up on the pressure side of the piston becomes sufficiently effective for controlling or slowing the closing speed over the last phase of the closing stroke.

In accordance with this invention, the breather arrangement may have various forms such as a continuous breather which allows air to leak into the vacuum chamber through either a fixed or an adjustable breather arrangement during the closing stroke. In another form, the breather may be an arrangement which allows air to leak onto the vacuum chamber only at a predetermined portion of the closing piston stroke, herein referred to as a localized breather. In still another form of the invention, a breather arrangement may be of a form which permits air to continuously leak into the vacuum chamber after the piston reaches a certain position of its closing stroke, which is herein referred to as a domain breather.

The initial volume of the vacuum chamber is the minimum volume of that chamber at the moment the door is released for closing. The arrangement is such that the volume of the vacuum chamber progressively decreases as the door is being opened, the minimum volume of the vacuum chamber being reached when the door is fully opened. The physics is such that the smaller the initial volume of the vacuum chamber, the faster will be the pressure drop within in the vacuum chamber and the stronger is the resulting resistance force acting on the piston. As a result thereof, the invention also utilizes a volume displacement device of various forms to reduce the initial volume of the vacuum chamber so as to enhance the resulting resistance forces acting on the piston for more uniformly controlling the closing speed of the door over the entire closing stroke of the door to render the door closer more user friendly.

IN THE DRAWINGS

FIG. 2 illustrates a side view of a typical prior art pneumatic door closer shown in cross section when an associated door is fully closed.

Figure 1:
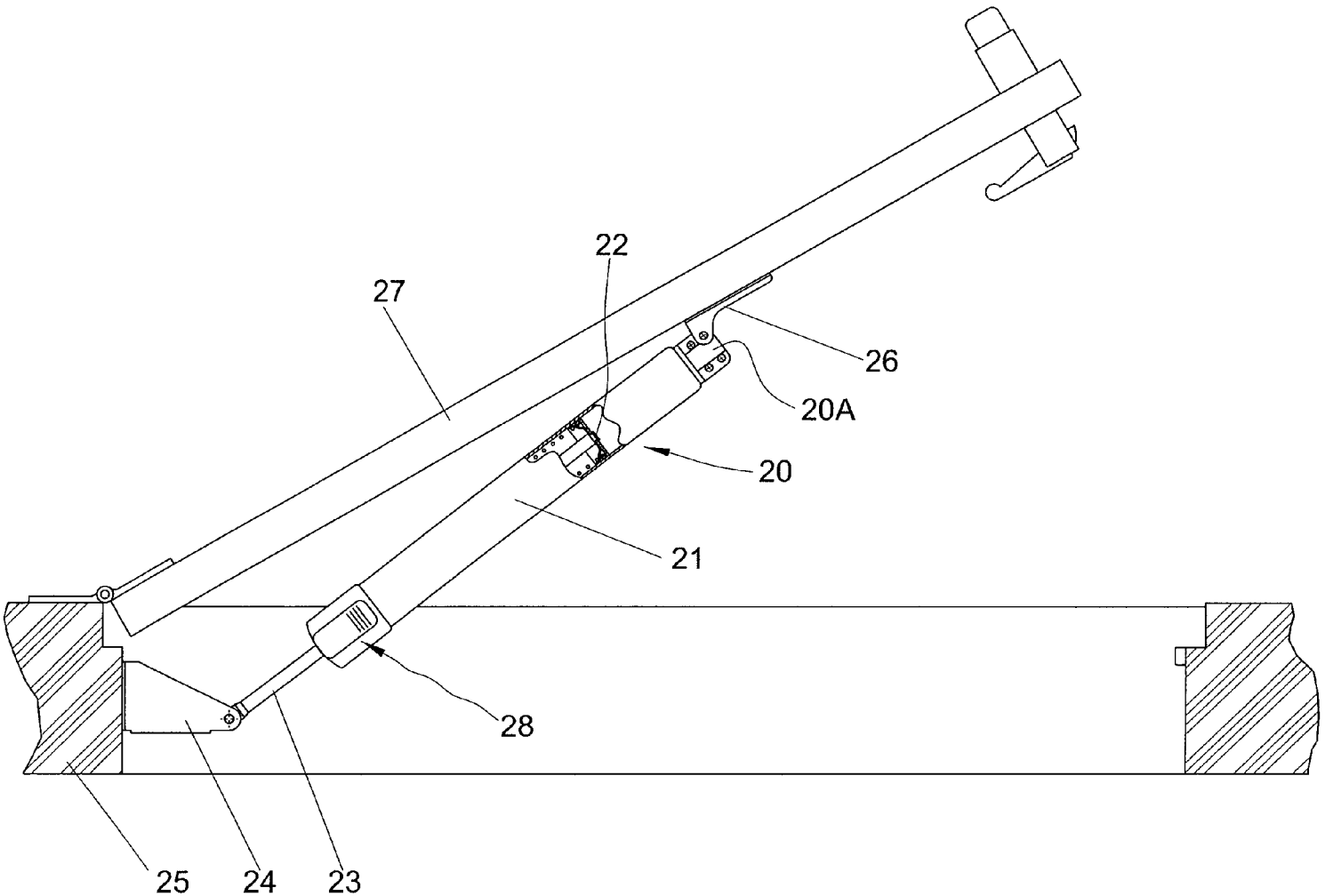
FIG. 1 illustrates a typical door closer installation relative to an associated door.

FIG. 2-A is a fragmentary side sectional view of the prior art pneumatic door closer of FIG. 2 illustrating the relative position of the piston component parts for allowing the free flow of air from one side of the piston to the other side thereof during the opening of an associated door.

FIG. 2-B is a fragmentary side sectional view similar to that of FIG. 2-A illustrating the relative position of the piston component parts to prohibit the reverse flow of any air from the pressure side of the piston to the other side of the piston during the closing stroke of the door.

FIG. 3-A is a sectional side view of an embodiment of the invention.

FIG. 3-B is a sectional side view of a modified form of the invention.

FIG. 3-C is a sectional side view of still another embodiment of the invention.

FIG. 4-A is a fragmentary sectional side view of FIG. 3-A illustrating a continuous breather detail.

FIG. 4-B is a fragmentary sectional side view of FIG. 3-A illustrating an adjustable continuous breather detail.

FIG. 4-C is a fragmentary sectional side view of a door closer illustrating another form of a continuous breather detail.

FIG. 4-D is a fragmentary sectional side view of another form of breather which is referred to as a localized breather.

FIG. 4-E is a fragmentary sectional side view of a door closer illustrating another form of a localized breather.

FIG. 4-F-1 is a sectional side view of a pneumatic door closer illustrating still another form of a modified breather showing the relationship of the parts during the beginning portion of the closing phase of the door.

FIG. 4-F-2 is a sectional side view similar to FIG. 4-F-1 showing the relationship of the component parts at an intermediate closing position.

FIG. 5-A is a sectional side view of another modified form of the invention having a volume displacement device disposed around the rod within the vacuum chamber.

FIG. 5-B is a sectional side view of the invention provided with a modified volume displacement device integrated with the cylinder front end wall.

FIG. 5-C is a sectional side view of another embodiment of the invention having another modified volume displacement device integrated with the piston.

FIG. 6-A is a sectional side view of another embodiment of the invention having a tension spring generating the biasing force acting on the piston.

FIG. 6-B is a section side view of another embodiment of the invention having a tension spring similar to FIG. 6-A with a piston having an integrated volume displacement device for the pressure chamber.

FIG. 7-A is a sectional side view of still another form of the invention wherein the component parts are illustrated in a fully door opened position.

FIG. 7-B is a sectional side view of the embodiment of FIG. 7-A illustrating the component parts at an intermediate point of the closing stroke of the door closer.

FIG. 8-A is a sectional side view of another embodiment of the invention having a vacuum chamber, a volume displacement device incorporated in the piston, and a localized breather arrangement on the rod illustrating the component parts moving in a door opening direction.

FIG. 8-A-1 is an enlarged partial detail section view of the piston of FIG. 8-A in a door opening mode.

FIG. 8-B is a sectional side view similar to FIG. 8-A illustrating the door closer in the full door opened position.

FIG. 8-C is a sectional side view similar to FIG. 8-B illustrating the component parts moving toward a door closing position or in a retracting mode.

FIG. 8-C-1 is an enlarged partial detail sectional view of the piston of FIG. 8-A-1 in a door closing mode.

FIG. 8-D is a sectional side view of the door closer of FIG. 8-C illustrating the retracting mode of the piston rod at a position that allows air to be sucked or leaked onto the vacuum chamber through a breather provided on the piston rod.

FIG. 8-E is a sectional side view of the door closer of FIG. 8-D illustrating the piston rod in its fully retracted or door closing position.

DETAILED DESCRIPTION OF THE PREFERRED EMBODIMENTS

Referring to the drawings, FIG. 1 illustrates a typical arrangement of a pneumatic door closer 20 which comprises an elongated cylinder or housing 21 having reciprocally mounted therein a piston 22 connected to a piston rod 23, the free or extended end thereof being pivotally connected to a suitable frame bracket 24 which may be fixedly mounted to the door frame 25. The end 20A of the cylinder opposite the piston rod 23 is pivotally mounted to a door bracket 26 connected to an associated door 27. A rod arresting means 28 of the type described in U.S. Pat. No. 5,630,248, which is incorporated by reference herein, for retaining the door in a selected open position, may be incorporated in the door closer 20. However, it will be understood that the rod arresting means 28 forms no part of the invention disclosed herein, as the door closer of the instant invention may be utilized with a door closer having no arresting means or with other known arresting means for retaining the door in any selected arrested open position.

As illustrated in FIGS. 2, 2A and 2B, a typical conventional or known type of a pneumatic door closer 30 includes an elongated cylinder 31 which is closed at one end 31A by an end cap 32 and at its other end 31B by an end wall 33 having an opening 34. Displaceably disposed within the cylinder 31 is a piston 35 connected to piston rod 36 having a free end 36A projecting outwardly of the cylinder 31 through the opening 34 in the end wall 33. The free end 36A of the piston rod is arranged to be pivotally connected to a suitable bracket, as noted in FIG. 1. A compression spring 37 is disposed within the cylinder 31 with one end of the spring 37 exerting a force on the piston 35 and the other end of the spring exerting a force on the front end wall 33. Associated with the piston is a unidirectional valving means similar to that described in U.S. Pat. No. 5,832,562, which is incorporated by reference herein.

As shown in FIGS. 2, 2A and 2B, the piston 35 is illustrated as comprising a disc shaped component 35A provided with one or more openings 39 and a connected generally conically shaped member 35B having an outer diameter which is slightly less than the internal diameter of the cylinder to define a space or passageway S therebetween. Disposed between the piston disc 35A and conical member 35B is a sealing member in the form of an O ring 38 which is arranged to function as a unidirectional valving means for permitting the air flow from the unpressurized side of the piston 35 to the other or pressure side of the piston 35 during the door opening stroke, as shown in FIG. 2A; and prohibiting the air to flow in the reverse manner during the door closing stroke of the piston, as shown in FIG. 2B. The end cap 32, which defines the rear end wall of the cylinder 31, is provided with a vent opening 40 through which the pressure side of the piston may be vented to atmosphere. The amount or degree of venting may be controlled or regulated by a needle or threaded type adjusting valve 41 to control the size of the vent opening in accordance to the adjustment of the valve 41.

As hereinbefore noted, such known pneumatic door closers functioned with a rate of closing speed that was not user friendly as the initial closing speed would cause the door to suddenly close upon an unsuspecting user to result in possible injury to the user.

Referring to FIG. 3A, there is disclosed one embodiment of the invention described herein. As shown, the pneumatic door closer 50 includes an elongated housing or cylinder 51 which is closed at its rear end by an end cap 52. The front end of the cylinder 51 is closed by a front end wall 53. In accordance with the present invention, sealing means are provided so that during the closing of the associated door, causing the piston and associated piston rod assembly to retract within the cylinder, vacuum is crated within chamber 50-V formed between the piston rod side of the piston 55 and the front end wall of cylinder 53 through which the piston rod 56 extends, said chamber 50-V being defined as a vacuum chamber. The front end wall 53 is connected to the front end of the cylinder or housing 51 in a manner that renders the connection impervious to air. To achieve such air impervious connection, the front end wall may be integrally formed as an integral wall 53B of the cylinder, as shown in FIG. 3-B, formed of an air impervious material that results in an air impervious attachment.

In the illustrated embodiment of FIG. 3-A, the front end wall 53 comprises a disc shaped member having an annular groove 53A forming a seat for a resilient O-ring seal 54 which is tightly fitted and secured to the cylinder 51 by swedging or deforming the front end of the cylinder 51 tightly about the outer periphery of the front end wall 53 whereby the O-ring insures an air impervious seal about the entire periphery of the front end wall 53.

In the embodiment shown in FIG. 3-C, the imperviousness of the joint of the front wall 81 to the cylinder 82 is achieved by appropriate processes and joining processes without the use of an O-ring.

A displaceable piston 55 is connected to a piston rod 56 whereby the piston and piston rod are reciprocally displaceable within the cylinder. The free end 56A of the piston rod 56 is arranged to extend through an opening 57 formed in the front end wall 53. The opening 57 is provided with a groove for accommodating an O-ring 57A arranged to provide an air impervious seal between the piston rod 56 and the internal periphery of the piston rod opening 57.

Disposed between the front end wall 53 and the piston 55 is a coil compression spring 59. As shown in FIG. 3-A, the compression spring 59 exerts a spring bias on the piston 55 to maintain the component parts of the door closer 50 in the normal door closing position, as illustrated in FIG. 3-A.

The piston 55 includes a piston disc 55A and an associated conically shaped piston member 55B which are connected to the end of the piston rod 56. The disc 55A is provided with one or more openings 60 to permit displaced air to flow therethrough during the opening stroke of the door closer 50, as will be described herein. The outer periphery of the conically shaped member 55B is formed with an outer diameter being slightly less than the internal diameter of the cylinder 51 to define a passageway S therebetween, as described with respect to FIG. 2-A.

Disposed in the space defined between the piston disc 55A and the conically shaped member 55B is a unidirectional valving member in the form of an O-ring 61.

The end cap 52 is provided with a vent opening 63 to vent the activating air medium to atmosphere, as will be herein described. If desired, the vent opening 63 may be provided with an adjusting means in the form of a needle valve or adjusting screw 63A for regulating the venting of air therethrough.

In order to limit the level of vacuum that develops within the vacuum chamber 50-V to a value that just slows the closing motion down without stopping the door completely, a breather means is provided to allow a small amount of air to enter into the vacuum chamber 50-V in a controlled way.

To control the speed of the door closing stroke, the front end wall 53 is provided with a breather means 64 which allows a controlled amount of air to be leaked into the vacuum being created within the vacuum chamber 50-V, as viewed in FIG. 3-A, during the door closing mode.

As best seen in FIGS. 3A and 4A, the breather means 64 is formed as an opening 65 having a fixed sized port 65, sufficient to control the leaking of a predetermined amount of air into the vacuum chamber being created on retraction of the piston rod 56 for obtaining an optimum slowing of the speed of the associated door during the initial phase of the closing stroke. For a given spring force and door weight, the vacuum pressure acting on the piston on the closing stroke of the door closer depends on the initial volume of the vacuum chamber 50-V and on the amount of air which is allowed to leak through the breather means into the vacuum chamber 50-V in accordance with this invention. The size of the breather means depends on the aerodynamic discharge coefficient of each particular geometry of the leakage passage. For an equivalent circular orifice having a 4/1 length to diameter ratio, the size of the opening 65 may vary in between 0.005-0.00001 square inches. One type of breather means 65 as described herein may be defined as a continuous breather as the air is permitted to continuously leak therethrough so long as there is a vacuum or negative pressure exists in the vacuum chamber 50-V upon the closing of the door.

FIG. 3-B illustrates a slightly modified pneumatic door closer 70 wherein the front end wall 53B is formed as an integral part of the cylinder or housing 71. In this form of the invention, the rod opening 72 in the front end wall 53B, through which the free end 73A of the piston rod 73 extends, is provided with an O-ring seal 72A to form an air impervious seal between the piston rod 73 and the rod opening 72.

The breather means in the form of a port opening 74, which extends through the front end wall 53B, which may be unregulated as described in FIG. 3-A or regulated as described with respect to FIG. 4-B herein. In all other respects, the structure of the door closer of FIG. 3-B is similar to that described with respect to FIG. 3-A.

FIG. 3-C is directed to another modified form of the invention. In this form of the invention, the pneumatic door closer 80 is provided with a front end wall 81 secured to the adjacent end of the cylinder 82 with an air impervious press fit or friction fit to prohibit any leaking of air into the cylinder during the closing stroke of the door closer. The tolerance of the opening 83 formed in the end wall 81, through which the piston rod 84 extends, is such as to limit the leakage of air into the vacuum chamber 80V to an amount that does not decrease the vacuum level below a value that renders it inoperative for the purpose of smoothing the closing motion of the door. Thus, for all practical purposes, the end wall 81 is sufficiently sealed to the cylinder 82 and at the opening 83 about the piston rod 84, simply by maintaining tolerance sufficiently close to render the vacuum chamber air tight so as to function in the manner herein described, viz. a pneumatic door closer having a controlled rate of closing during the entire closing stroke that is generally uniform, smooth and safe to the user. Disposed in and extending through the front end wall 81 is a continuous breather means 85 which is similar to that described in respect to FIG. 4-A or 4-B. In all other respects, the door closer 80 is similar to the door closer 50 of FIG. 3-A, which need not be repeated. Depending on the technological capabilities of one wishing to produce the pneumatic door closer described herein, the function of the breather means 85 could be taken by the close tolerances interstice in between the piston rod 84 and the front wall 83. Condition is that the equivalent discharge coefficient be within the limits disclosed in the present invention.

FIG. 4-B is directed to a further modified embodiment of the invention. As disclosed in FIG. 4-B, the pneumatic door closer 90 is similar to that described with respect to FIG. 3-A, but differs therefrom in that the breather means 91 includes a port opening 92 which is controlled by a needle valve or screw valve 93 to adjust the amount of air that is permitted to leak or bleed into the vacuum chamber 90V that is created within the cylinder 94 on the closing stroke of the door closer 90.

FIG. 4-C is directed to still another embodiment of the invention. In this embodiment, the door closer 100 is similar to that described with respect to FIG. 3-C, except that the breather means 101 comprises a small breather hole 102 that extends through the piston 103 instead of the front end wall 106, as in FIG. 3-C. The breather hole 102 functions as a continuous breather wherein a controlled amount of air is permitted to flow from the pressure chamber 104 to the vacuum chamber 100V in order to limit the level of vacuum that develops within the vacuum chamber 100V to a value that just slows down and controls the closing motion without stopping the door completely.

FIG. 4-D illustrates a further embodiment of the invention. In this form of the invention, the door closer 110 includes a cylinder or housing 111 similar to the cylinder 70 of FIG. 3-B, except that the cylinder or housing 111 is provided with a channel 112 that defines a passageway P on its inner wall that has a longitudinal length A-B with a controlled width sufficient to function as a breather means for leaking a predetermined amount of air from the pressure side 114 of the piston to the vacuum chamber side 111V of the piston when the piston 113 reaches and traverses the length of the passageway 112 during the closing stroke of the door closer 110. The amount of air which is permitted to be leaked from the pressure side of the piston to the negative side thereof during the closing stroke is controlled by the length and width of the passageway P. Breather means 112 as described herein may also be referred to as a localized type breather, meaning the breather becomes effective only along a predetermined portion of the closing stroke during the closing stroke of the piston as illustrated in FIG. 4-D.

FIG. 4-E illustrates a door closer 120 similar to that hereinbefore described with respect to FIG. 3-A, but differing therefrom in that instead of the breather means 64, 65 of FIG. 3-A, a modified localized breather means 121 is utilized in door closer 120. In this form of the invention, the localized breather means 121 is in the form of a groove or cut out portion 122, having a linear length A-B, formed in the outer surface of the piston rod 123 at a predetermined location. In all other respects, the door closer 120 is similar to that described with respect to FIG. 3-A. In the form of the invention of FIG. 4-E, the air that is permitted to leak into the vacuum chamber 120V, being created as the piston rod 123 is being retracted on the closing stroke, only during the time that the groove 122 formed in the piston rod 123 passes by the sealing means 125 formed about the rod opening 126 in the front end wall 127 of the cylinder 128. In all other respects, the structure and principle of operation of door closer 120 is similar to the door closer of FIG. 3-A.

FIGS. 4-F-1 and 4-F-2 illustrate a further embodiment of the present invention. As illustrated therein, the pneumatic door closer 130 is generally similar to that disclosed and described with respect to FIG. 4-D and the other embodiments herein described, but differs therefrom in that the embodiment of FIGS. 4-F-1 and 4-F-2 utilizes a domain type breather means instead of a continuous breather means or a localized breather means, as described with respect to FIG. 4-D or 4-E. In FIGS. 4F-1 and 4F-2, the pneumatic door closer 130 utilizes a domain type breather means. As shown in FIGS. 4-F-1 and 4-F-2, the domain breather means includes a small opening 131 formed in the shell of the cylinder or housing 132. In the fully open position of the door, when the rod 135 is fully extended, as shown in FIG. 4-F-1, the breather opening or hole 131 is in communication with the pressure chamber portion 136 formed on the right side of the piston 134 as shown in FIG. 4-F-1. In this form of the invention, as the piston rod 135 and connected piston 134 begin to retract into the cylinder 132 and toward a door closing direction, a vacuum begins to be created on the vacuum chamber 130V. In doing so, the air on the other side or pressure side 136 of the piston is being vented to atmosphere in a controlled manner through a vent means 137, as previously described, and through the orifice 131, which functions also as a breather. As the piston 134 passes the breather hole 131, the atmospheric air is permitted to leak into the vacuum being created on the vacuum chamber 130V during the closing stroke of the door closer. As previously described and as will be further described herein, the leaking of atmospheric air into the vacuum being created in the vacuum chamber 130V on the closing stroke of the piston functions to gradually diminish the level of vacuum created in the vacuum chamber of the cylinder to result in a uniform closing speed throughout the closing stroke.

The operation of the respective door closers disclosed herein operate as follows:

Referring to FIG. 3-A, in the closed door position of the door, the piston 55 of the door closer 50 is totally retracted within the cylinder 51. As one begins to open the door (not shown), the piston rod 56 begins to extend outwardly through the sealed opening 57 of the front wall 53, causing the piston 55 to be displaced to the left. As the piston 55 is being pulled to the left by the piston rod 56 being extended by the opening of the door, the piston seal 61 is positioned adjacent the piston disc 55A to unblock the space S, causing the air in the vacuum chamber 50V to be evacuated or flow through the passageway S, under the piston seal 61 and through the disc opening 60 into the pressure chamber formed on the right side of piston 55, in the manner shown in FIG. 2-A.

In the door fully opened position, wherein the piston rod 56 and associated piston 55 is fully extended, the volume of the vacuum chamber 50V is at its minimum volume level. As the door is released, the piston rod 56 and its associated piston 55 begin to retract as a result of the spring bias acting on the piston 55. On retraction of the piston rod and associated piston within the cylinder, the piston seal 61 effectively seals the passageway S to prohibit any back flow of the air present in the pressure chamber formed in the right side of the piston 55, while the sealing means 57A and 54 prevent any air to be ingested through the rod opening 57 or through the assembly area of the cylinder with its front wall 53. Thus, on the initial portion of the closing stroke a vacuum is being created on the left side of the piston as the piston is displaced to the right. Because the vacuum chamber is effectively sealed at the front and back thereof, a vacuum is created within the vacuum chamber 50V to cause the pressure within the vacuum chamber to rapidly drop below atmospheric pressure during the initial portion of the closing stroke as pressure of the air in the pressure chamber is slower to build up during this first portion of the closing stroke. The rapid drop of pressure in the vacuum chamber and the increase of pressure occurring on the pressure chamber side of the piston create a resultant pressure differential which is higher than occurs in conventional pneumatic door closers. The vacuum contributes most of the resistance force that tends to slow the closing speed of the door closer during the initial closing phase of the door. As the piston rod and associated piston continues to retract, the increasing resistance forces is limited or controlled by decreasing the level of vacuum within the vacuum chamber by the controlled leaking of the air into the vacuum chamber and the control of venting of the air pressure accumulating in the pressure chamber of the cylinder.

In the embodiments disclosed in FIGS. 3-A, 3-B, 3-C, 4-A, 4-B and 4-C, the illustrated breather means are defined or referred to as continuous breathers, that is they permit air to be leaked into the vacuum chamber throughout the stroke of the door closer between the fully open to fully closed position of the door closer. The amount of air which the continuous breather means herein described permit to be leaked into the vacuum chamber is controlled either by the size of the port opening and/or by a valving means that is rendered adjustable to vary the size of the port opening.

FIG. 4-D and FIG. 4-E disclose a type of a localized breather means which permit the leaking of air into the vacuum chamber only at a selected portion of a closing stroke.

It is to be noted that with the various door closers described herein and the manner in which they function are distinctive in that the relevant resistance forces acting on the piston are enhanced by the creation of the vacuum chamber by sealing and rendering the chamber on the piston rod side impervious to air. This produces a higher resultant pressure differential by causing the pressure in the vacuum chamber to drop substantially below the atmospheric pressure on the vacuum side of the piston to result in a slowing of the closing speed. The even greater benefit is that the component of the resistance force created by the vacuum chamber is larger at the beginning of the stroke where the pressure contribution is still low and thus it enables an enhanced mode of distributing the resistance forces on the piston throughout the entire stroke thereof that ultimately achieve a substantially uniform and smooth closing speed that are only normally achieved with hydraulically operated door closers.

It is further to be noted that the smaller the initial volume of the vacuum chamber, the faster is the pressure drop in the vacuum chamber to result in a stronger resulting resistance force acting on the piston to slow the closing speed of the door closer during the initial portion of the closing stroke.

Referring to FIG. 5-A, there is disclosed a modified door closer 140. The structure of door closer 140 is similar to that described with respect to FIG. 3-A, except that a volume displacer 141 is disposed between the piston 142 and the front end wall 143 of the cylinder 144. In the illustrated embodiment of FIG. 5-A, the volume displacer 141 comprises an elongated tube or sleeve like structure having a bore 141A extending therethrough, through which the piston rod 145 extends. It will be understood that the volume displacer 141 is disposed about the piston rod 145 in a manner so as to not interfere with the action of the compression spring 146. In all other respects, the structure of door closer 140 is similar to that described with respect to FIG. 3-A.

FIG. 5-A illustrates the door closer 140 with the piston rod 145 and associated piston 142 in its fully extended or fully opened door position. In this position, the volume displacer 141 minimizes the volume of the vacuum chamber 140V by occupying a major portion of the vacuum chamber volume that contains the compression spring 146. Due to the minimum volume of the vacuum chamber at the start of the closing stroke and upon the release of the door, the pressure drop occurs faster in the vacuum chamber to result in a stronger resistance force being imparted on the piston, so as to slow the rate of closing during the initial closing phase.

FIG. 5-B illustrates a modified door closer 150 utilizing another form of a vacuum volume displacer. In FIG. 5-B, like in FIG. 5-A, the piston rod 151 and its associated piston 152 are illustrated in the fully extended position of the piston rod 151 or in the fully opened door position. In this form of the invention, the volume displacer means 153 is integrated into the front wall means 154 of the cylinder 155. In this form of the invention, the illustrated front wall means 154 includes an annular member 154A having a center opening 154B, through which the piston rod 151 extends. Connected to the annular member 154A and extending inwardly into the vacuum chamber 150V there is a sleeve 157 provided with an end wall 158 disposed adjacent to the piston 152. The end wall 158 of the volume displacer 153 is provided with a center opening 159 having a groove formed about the inner periphery of the center opening to form a seat for retaining a sealing O-ring 160 to form an air tight seal between the inner periphery of the center opening 159 and the piston rod 151 extending therethrough. The outer end portion of the volume displacer 153 is provided with an outwardly extending radial flange 162 formed with an outer annular groove 163 defining a seat retaining a sealing O-ring 164 therein to form an air tight seal between the front wall volume displacer 153 and the cylinder 155.

In this form of the invention, the center opening 154B of the annual front wall member 154A need not be in sealing relationship with the piston rod extending therethrough. Also, in this form of the invention, the inner end wall 158 of the volume displacer sleeve is provided with a breather means 165 similar to a continuous breather means as described with respect to either FIGS. 3-A, 3-B, 3-C, and 4-A. It will be understood that the sleeve 157 of the volume displacer 153 is arranged so as to not interfere with the functioning of the compression spring 169. In all other respects, the structure of door closer 150 is similar to that described with respect to FIG. 3-A. The door closer 150 mode of operation is similar to that described with respect to FIG. 3-A.

FIG. 5-C illustrates a further embodiment of a door closer embodying the invention herein. As shown, the door closer 170 in FIG. 5-C includes a cylinder 171 similar to the cylinder of FIG. 3-A. However, the door closer 170 utilizes a volume displacer means 172 which is integrally incorporated in the piston 173, which is connected to the piston rod 174.

As shown in FIG. 5-C, the piston/volume displacer element 172/173 is shaped like an elongated cup with the end wall 173A connected to the piston rod 174. The other, or open end of the piston/volume displacer element 172 is provided with a radially outward circumscribing flange 175 like portion which is actually the portion for forming the piston sealing and valve means as hereinafter described with respect to FIGS. 8-A-1 and 8-C-1.

FIGS. 8-A-1 and 8-C-1 illustrate an enlarged detail of the piston/volume displacement element 172/173. As shown in FIG. 5-C and FIG. 8-A-1, the outwardly extending radial flange 175 is provided with a circumscribing groove 176 having a configuration as shown in FIG. 8-A-1. As shown, the rear wall 176A of the groove is radially disposed and has an outer circumference with a diameter which is smaller than the internal diameter of the cylinder 171. The rear wall 176A of the groove 176 is also provided with one or more openings 177. The other or front wall 176B of the groove 176 is provided with an incline surface 176C. The outer circumference of the front wall 176B has a diameter which is less than the inner diameter of cylinder 171 so as to define a space S which forms an air passageway whereby displaced air may flow from the vacuum chamber, pass the piston, and into the pressure chamber as indicated by arrow A (FIG. 8-A-1).

Disposed in the groove 176 between the rear and front walls 176A, 176B thereof is a seal 178 in the form of an O-ring. As best seen in FIG. 8-A-1, as the piston is moved to the left toward the door opening position of the door closer, the sealing O-ring 178 is resting against the rear wall 176A of the piston/volume displacement element 172/173 so as to unblock the passageway S, thus allowing the displaced air to flow from the vacuum chamber to the pressure chamber as indicated by arrow A in FIG. 8-A-1.

On the retraction of the piston rod 174 or toward the door closing position of the door closer, the sealing O-ring is shifted toward the front wall 176B where, with the assistance of the generally conical cam surface 176C causes the O-ring to seal the passageway S and blocks any air flow from the pressure side of the piston to the vacuum side thereof during the door closing stroke of the door closer, as described herein.

FIG. 8-C-1 shows the piston/volume displacement element relative to the sealing O-ring 178 in the blocking position during the closing stroke of the door closer.

It will be understood that, as illustrated in FIG. 5-C, the piston/volume displacer element 172 is illustrated in its fully opened door or piston-rod extended position. In all other respects, the door closer 170 is similar in structure and mode of operation as hereinabove described.

FIG. 6-A illustrates another embodiment of a door closer embodying the present invention. In this form of the invention, the door closer 180 is provided with a cylinder 181 having a displaceable piston 182 connected to a piston rod 183, the free end thereof being extended through a front end wall 184 which is connected to the end of the cylinder with an air impervious seal means, as hereinbefore described.

In this form of the invention, the piston 182 is normally biased toward its retracted or door closing position by means of a tension spring 185. One end of the tension spring 185 is connected to the piston, and the other end of the tension spring is suitably anchored to the rear end wall 186 of the cylinder 181.

As seen in FIG. 6-A, the piston 182 is provided with a circumscribing groove 187, one side 187A being inclined and the other side 187B being generally radial, the radial side having one or a plurality of openings 187C through which air may be evacuated from the vacuum chamber to the pressure chamber while the door is being opened. As noted in FIG. 6-A, the piston merely comprises the piston head containing the uniquely circumscribing groove 187 for retaining therein a sealing gland or O-ring 188 which is structurally and functionally similar to that hereinbefore described. It is to be noted the left side 182A of the piston 182 is generally flat so that in the fully open position of the door, the side 182A will be generally in closely abutting relationship with the front wall 184 of the cylinder 181, such that the minimum volume of the vacuum chamber becomes practically zero. In the fully open door position, the tension spring 185 is fully extended so as to impart a spring bias on the piston 182 for effecting the retraction of the piston upon the release of the door by a user. In all other respects, the door closer 180 is similar in structure and mode of operation as described with respect to FIG. 3-A, except that in the fully opened position, the vacuum chamber created on the left side of the piston 182 will attain a substantially smaller minimum volume or close to zero so as to attain a maximum drop in pressure below atmosphere during the initial closing phase of the door closer, thereby maximizing the resultant resistance forces acting on the piston 182 to slow the initial rate of closing of the door so as to achieve a generally uniform, smooth and safe closing of an associated door.

FIG. 6-B illustrates a further embodiment of the invention. In this form of the invention, the door closer 190 includes a cylinder similar to that shown in FIG. 6-A and as further described with respect to FIG. 3-A, except that the embodiment of FIG. 6-B incorporates a combined piston and volume displacement element 192 in the pressure chamber. As described with respect to FIG. 6-A, the door closer 190 of FIG. 6-B includes a tension spring 193 that exerts a spring bias on the combined piston and volume displacement element 192. The piston portion 192A is disposed on the left side of the combined piston and volume displacement element 192 with the displacement portion 192B extending to the right side of the piston portion 192A, as viewed in FIG. 6B. Thus, in the normally closed position of the door, the volume displacement portion is disposed within the pressure chamber portion of the cylinder 191.

It will be understood that the volume displacement element may be formed as an extension of the piston as shown in FIG. 6-B or as an extension of the end cap or rear wall 194 for decreasing the volume of the pressure chamber, which volume displacers increase, in this case, the pressure in the pressure chamber toward the end of the closing stroke.

The breather means 188A and 195 in FIGS. 6-A and 6-B respectively, are illustrated as a continuous air breather, as hereinbefore described. The respective venting means 189 and 196 are similar to those hereinbefore described with respect to FIG. 3-A. However, it will be understood that any of the types of breather means hereinbefore described may be utilized as a substitute for the continuous breather disclosed in FIGS. 6-A and 6-B herein. In all other respects, the structure and function of the door closers of FIGS. 6-A and 6-B are similar to the corresponding door closer structure and function hereinbefore described.

FIG. 7-A and 7-B illustrate a further embodiment of a door closer 200. As shown, the door closer 200 illustrates how the principles of the invention disclosed herein is applied in a door closer 200 that embodies a plurality of vacuum and pressure chambers disposed within a common elongated cylinder or housing 201. As shown, the door closer 200 is provided with an elongated cylinder or housing 201 in which there is provided an intermediate wall 202 which partitions the cylinder 201 to define multiple chambers, e.g. chamber A and chamber B. While two (2) such chambers A and B are shown in FIGS. 7-A and 7-B, however, it will be understood more than two such chambers may be formed within the cylinder housing 201, if desired. A front end wall 203 and the partition wall 202 are secured to the cylinder 201 so as to form an air tight connection as hereinbefore described.

Reciprocally disposed within the common cylinder 201 is a piston rod 205 which is sufficiently long so as to extend through aligned opening 203A and 202A formed in the front wall 203 and the intermediate or partition wall 202, respectively.

As shown in FIGS. 7-A and 7-B, an O-ring seal circumscribes the respective openings 203A and 202A to provide an air impervious seal between the inner periphery of the respective openings 203A and 202A and the outer periphery of the piston rod 205 in a manner as hereinbefore described with respect to FIG. 4-C.

Connected to the piston rod 205 are a pair of pistons 206 and 207 spaced along the rod 205, whereby piston 206 is reciprocally displaceable within the forward chamber A and piston 207 is reciprocally disposed within the rear chamber B. In the illustrated embodiment, a compression spring 210 is disposed between the intermediate wall 202 and a radial outwardly extending flange 208 circumscribing one end of the piston 207. The compression spring 210 functions to retract the piston rod and its associated pistons 206 and 207 within their respective chambers upon release or closing stroke of the door closer 200.

In this form of the invention, the piston 206 is similar to the piston described with respect to FIG. 6-A. In addition thereto, the piston 206 is provided with a continuous breather means 211 which permits air on the pressure side of the piston 206 to be leaked into the vacuum being created in the expanding vacuum chamber disposed to the left side of the piston 206, during the closing stroke of the door closer 200. The air being compressed on the pressure side of piston 206 is vented to atmosphere through a metering venting hole 212 formed in the wall of the housing or cylinder 201 adjacent the partition wall 202. The breather means 211 is in the form of a small hole extending through the piston 206, which functions in a manner similar to that described with respect to the embodiment of FIG. 4-C.

The structure and function of piston 207 is similar to the piston described with respect to FIG. 5-C, which includes a volume displacer portion as described therein, and in FIGS. 8-A-1 and 8-C-1. In addition thereto, the piston/volume displacement element 207 includes a breather means 213 formed in the end wall 207A of piston 207. It will be understood that the breather means 213 may be a continuous type breather in the form of a hole that extends through the end wall 207A of the piston 207, as hereinbefore described.

In this form of the invention, the chamber B is provided with a metering venting means 214 disposed in the end wall 204 of chamber B, which in structure is similar to the vent means hereinbefore described with respect to FIG. 3-C.

In the fully closed position of an associated door, the compression spring 210 normally exerts a spring force on piston 207, wherein piston 207 is disposed adjacent the end wall 204 and piston 206 disposed adjacent the intermediate partition wall 202. As the associated door is opening, the piston rod 205 is extended, causing the respective pistons 206 and 207 to be displaced within their respective chambers A and B. As piston 206 is being displaced in the door opening direction, the air present in the portion of the vacuum chamber to the left side of the piston 206 is permitted to flow or evacuate about the periphery of the piston 206 described with respect to FIG. 8-A-1 as the volume of the vacuum chamber is diminishing and the volume of the pressure chamber is expanding. The air present in the vacuum portion of chamber B is also similarly displaced. In the fully opened door position, as best seen in FIG. 7-A, the vacuum chamber portions of chambers A and B are at their minimum volume.

Upon release of an associated door (not shown), the force of the spring 210 acting on piston 207 causes the piston rod 205 and its connected pistons 206 and 207 to retract into the respective chambers A and B. In doing so, a vacuum being created within the respective vacuum chamber portions VA, VB of the cylinder housing 201 whereby the pressure rapidly drops substantially below atmospheric pressure and thereby enhancing the resultant resistance forces acting on the respective pistons to result in a slowing of the closing rate of the door during the initial closing phase of the closing stroke. The breather means 211 and 213, which function to gradually diminish the level of the vacuum being created on the vacuum side of the respective piston such that the resulting resistance forces acting on the pistons are tuned such not to stop the motion completely, but to provide a uniform motion throughout the closing stroke. In the embodiment of FIGS. 7-A and 7-B, a portion of the air present in the pressure chamber is being permitted to leak into the vacuum chamber through the respective breather means 211 and 213 to effect the gradual diminishing of the level of the vacuum within the respective vacuum chamber portions during the closing stroke, as hereinbefore described.

FIGS. 8-A to 8-E are directed to another embodiment of a pneumatic door closer utilizing a piston having an integrated volume displacer portion and a localized type breather means. As shown, the door closer 220 utilizes a construction which is similar to that described with respect to FIG. 5-C, except that the embodiment of FIGS. 8-A to 8-E utilizes a localized breather formed as a groove 222 on the piston rod 223 similar to that described with respect to FIG. 4-E, instead of a continuous breather means 176 disclosed in FIG. 5-C. In all other respects, the structure of the door closer 220 is similar to that already described herein. Accordingly, the structure of the door closer 220 that is common with the described structure of FIG. 5-C will be referenced by the same reference numeral where mentioned, unless otherwise indicated.

As shown, the front end wall 224 of the door closer 220 is sealed to the end of the cylinder 221 to form an air impervious connection therewith, both about the outer periphery of the end wall 224 with the cylinder 221 and about the outer surface of the piston rod 223 extending through the rod opening 225 in the end wall 224.

FIG. 8-E illustrates the door closer 220 in its normal door closing position or inoperative position. In this position, the breather means 222 is located in the vacuum chamber portion 227 of the cylinder 221. As the associated door is being opened, the piston rod 223 begins to be extended outwardly of the cylinder 221, as illustrated in FIG. 8-A. As the piston 173 is being displaced toward its fully door open position, as noted in FIG. 8-A, any air present in the vacuum chamber portion to the left of the piston 173 will be evacuated through the passageway S and into the pressure chamber portion 128 of the cylinder 221 as indicated by arrow A in FIG. 8-A-1. When the piston 173 reaches its fully opened door position, as shown in FIG. 8-B, the vacuum chamber portion 127 of the cylinder has reached its minimum volume.

Upon the release of the associated door, the force exerted by the bias of the compression spring 226 causes the piston 173 and the associated piston rod 223 to retract into the cylinder and toward the door closing position. (FIG. 8-C) As noted in FIG. 8-C, as the piston 173 and associated rod 223 begin to retract, a vacuum is being created in the vacuum chamber 127 behind the piston thereby causing the pressure within the vacuum chamber 127 to drop substantially below atmospheric pressure quite rapidly. At the stage of operation noted in FIG. 8-C, while the piston rod 223 has begun its retraction, the position of the breather groove 222 has not yet entered or made communication with the interior of the vacuum chamber 127. As a result, the rate of the door closing during this initial phase of the closing stroke has been slowed as the resultant pressure differential caused by the substantial drop in pressure achieved in the vacuum chamber 127 and to a lesser extent to the increase in the pressure within the pressure chamber 128.

As the piston rod 223 continues to retract to a position shown in FIG. 8-D, the breather groove 222, as it reaches the piston rod opening 225 in the end wall 224, begins to permit atmospheric air to leak into the vacuum chamber 127 to diminish the level of vacuum within the vacuum chamber 127 as the air within the pressure chamber 128 opposed to the piston has been sufficiently compressed to a level that will counterbalance the force of the spring and the inertia of the door so as to exert a sufficient amount of pressure on the piston to control the rate of closing of the door during the final portion of the door closing. The initial creation of the vacuum within the essentially air tight vacuum chamber portion 127 of the cylinder causes the pressure in the vacuum chamber to drop substantially below atmospheric pressure on the vacuum side of the piston during the initial phase of the closing or retraction of the piston, and with the subsequent progressive diminishing of the vacuum caused by the breather means 222, coupled with the build-up of the air pressure within the pressure chamber 128 during the approximate final one third of the closing stroke, enables the door closer 220 to achieve a generally uniform, smooth and safe rate of speed throughout the entire closing stroke of the door closer.

While the various embodiments disclosed herein may vary from one to the other, it will be understood that the various component parts thereof may be interchanged with a corresponding component of the various disclosed embodiments, e.g. one form of breather may be interchanged with another form of breather means, and various other modifications may be made without departing from the spirit and scope of the invention.

What is claimed is:

1. A pneumatic door closer comprising:

an elongated cylinder having opposed end walls, one of said end walls having a rod opening therein, a piston reciprocally disposed within said cylinder to define a spring side vacuum chamber appropriately sealed and capable of selectively maintaining a pressure substantially lower than normal atmospheric pressure substantially indefinitely on said rod opening side of said piston and a pressure chamber on the other side of said piston within said cylinder, said piston including a unidirectional valving means for controlling unidirectional passage of air between said spring side vacuum chamber and said pressure chamber, a piston rod connected to said piston, said piston rod having a free end extending through said rod opening, a controlled vent place on the other one of the opposed end walls adjacent said pressure chamber, whereby pressure may be controllably released from said pressure chamber as said piston moves towards said controlled vent, a seal placed in the rod opening around said piston rod at said one of said end walls, wherein said seal is capable of maintaining a pressure substantially lower than normal atmospheric pressure substantially indefinitely in the spring side vacuum chamber, spring means disposed within said cylinder and said spring side vacuum chamber for imparting a spring bias on said piston to normally urge said piston toward the other end wall of said opposed end walls, and a breather means disposed intermediate the opposed end walls of said elongated cylinder and selectively in communication with said spring side vacuum chamber for controlled introduction of air into said spring side vacuum chamber for decreasing the level of vacuum created in said spring side vacuum chamber and selectively in communication with said pressure chamber for allowing additional air from the pressure chamber to escape during the closing stroke of the piston, wherein when said piston rod is fully extended and said piston is between said seal and said breather means and said piston advances towards the other one of the opposed end walls a vacuum begins to be created in said spring side vacuum chamber and air in said pressure chamber is vented to atmosphere through said controlled vent and said breather means whereby a vacuum is formed in the spring side vacuum chamber providing a substantial resistance force acting against said spring means slowing a closing speed of a door until said piston passes said breather means preventing additional air escaping from said pressure chamber and permitting atmospheric air to leak into said spring side vacuum chamber through said breather means gradually diminishing the vacuum in said spring side vacuum chamber resulting in a substantially uniform closing speed until said piston is adjacent the other one of the opposed end wall.

2. A pneumatic door closer as defined in claim 1 wherein said breather means comprises a small port opening.

3. A pneumatic door closer as defined in claim 1 wherein said one end wall is integrally connected to said elongated cylinder so as to render an air impervious connection therebetween.

4. A pneumatic door closer for effecting the closing of an associated door with a generally smooth and uniform closing motion in moving from an opened to closed position comprising:

an elongated cylinder housing having opposed end walls, one of said opposed end walls having a rod opening extending therethrough, a piston reciprocally disposed within said cylinder housing to define a spring side vacuum chamber capable of selectively maintaining a pressure substantially lower than normal atmospheric pressure on the rod opening side of said piston, and a pressure chamber on the other side of said piston, a piston rod connected to said piston, said piston rod having a free end extending through said rod opening, a controlled vent adjacent the pressure chamber placed in the other one of said opposed end walls, a seal placed in the rod opening around said piston rod at said one of said opposed end walls having a rod opening extending therethough, spring means, placed within the spring side vacuum chamber of said elongated cylinder, for exerting a spring bias on said piston and associated piston rod for normally urging said piston toward a door closing position of said piston, means associated with said piston for allowing unidirectional flow of air from said spring side vacuum chamber to said pressure chamber during the opening of a door and prohibiting any backflow of air to said spring side vacuum chamber during the closing stroke of the piston for creating a vacuum within said spring side vacuum chamber during the closing stroke of said piston, and a breather means for introducing predetermined amount of air into said spring side vacuum chamber for controlling the level of vacuum being created therein and to allow additional air from the pressure chamber to escape during the closing stroke of said piston, wherein when said piston rod is fully extended and said piston is between said seal and said breather means and said piston advances towards the other one of said opposed end walls a vacuum begins to be created in said spring side vacuum chamber and air in said pressure chamber is vented to atmosphere through said controlled vent and said breather means whereby a vacuum is formed in said spring side vacuum chamber providing a substantial resistance force acting against said spring means slowing a closing speed of a door until said piston passes said breather means preventing additional air escaping said pressure chamber and permitting atmospheric air to leak into said spring side vacuum chamber through said breather means gradually diminishing the vacuum in said spring side vacuum chamber resulting in a substantially uniform closing speed until said piston is adjacent the other on of said opposed end walls.

5. A pneumatic door closer for effecting the closing of an associated door with a generally smooth and uniform closing motion in moving from the opened to closed position thereof comprising:

an elongated cylinder having opposed end walls, one of said end walls having a rod opening therein, a piston reciprocally disposed within said cylinder to define a spring side vacuum chamber capable of maintaining a pressure substantially lower than normal atmospheric pressure substantially indefinitely on the rod opening side of said piston and a pressure chamber on the other side thereof within said cylinder, a piston rod connected to said piston, said piston rod having a free end projecting through said rod opening in said one end wall, a seal placed in the rod opening around said piston rod at said one of said end walls having a rod opening therein, wherein said seal is capable of maintaining a pressure substantially lower than normal atmospheric pressure substantially indefinitely in the spring side vacuum chamber, said piston including a unidirectional valving means for permitting air in said spring side vacuum chamber to be exhausted to said pressure chamber during the door opening stroke of said piston, and prohibiting any backflow of said air from said pressure chamber to said spring side vacuum chamber during the door closing stroke of said piston, means for controllably venting said pressure chamber, spring means disposed within said spring side vacuum chamber of said cylinder for imparting a spring bias on said piston that normally urges said piston toward the other end wall of said opposed end walls, and a breather means disposed selectively in communication with said spring side vacuum chamber for permitting controlled introduction of atmospheric air into said spring side vacuum chamber for decreasing the level of vacuum created in said spring side vacuum chamber during the closing stroke of said piston allowing said piston to move in a controlled way and selectively in communication with said pressure chamber for permitting controlled release of air from said pressure chamber, wherein when said piston rod is fully extended and said piston is between said seal and said breather means and said piston advances towards the other end wall of said opposed end walls a vacuum begins to be created in said spring side vacuum chamber and air in said pressure chamber is vented to atmosphere through said controlled vent and said breather means whereby a vacuum is formed in the spring side vacuum chamber providing a substantial resistance force acting against said spring means slowing a closing speed of a door until said piston passes said breather means preventing additional air from escaping from said pressure chamber and permitting atmospheric air to leak into said spring side vacuum chamber through said breather means gradually diminishing the vacuum in said spring side vacuum chamber resulting in a substantially uniform closing speed until said piston is adjacent the other end wall of said opposed end walls.

6. A pneumatic door closer having a spring side vacuum chamber and a pressure chamber for smoother door closing comprising:

an elongated tube having a first end and a second end;

a first end wall placed in the first end, said first end wall having a piston rod opening;

a second end wall placed in the second end of said elongated tube;

a piston placed within said elongated tube dividing said elongated tube into the spring side vacuum chamber and the pressure chamber, the spring side vacuum chamber capable of maintaining a pressure substantially lower than normal atmospheric pressure substantially indefinitely;

a piston rod attached to said piston and extending through the piston rod opening;

a seal placed in the piston rod opening around said piston rod at said first end wall, wherein said seal is capable of maintaining a pressure substantially lower than normal atmospheric pressure substantially indefinitely in the spring side vacuum chamber, unidirectional piston sealing valve means, associate with said piston, for controlling air flow past the inner wall surface of said elongated tube between the spring side vacuum chamber and the pressure chamber, whereby when said piston rod is drawn out of said elongated tube and said piston is moved towards the first end wall during opening of a door air flow is permitted into the pressure chamber and when said piston rod is drawn into said elongated tube during closing of the door and said piston is moved towards the second end wall air flow between the pressure chamber and the spring side vacuum chamber is prevented past the inner wall surface of said elongated tube;

a spring sealed within the spring side vacuum chamber in said elongated tube, wherein said spring biases said piston towards said second end wall;

a pressure vent communicating with the pressure chamber, whereby said pressure vent controllably releases air pressure from the pressure chamber; and vent breather means, communicating with the spring side vacuum chamber and the pressure chamber depending upon a longitudinal position of said piston, for controllably permitting air to initially escape the pressure chamber and then enter the spring side vacuum chamber as said piston moves towards the second end wall, wherein when said piston rod is fully extended and said piston is between said seal and said vent breather means and said piston advances towards said second end wall a vacuum begins to be created in the spring side vacuum chamber and air in the pressure chamber is vented to atmosphere through said pressure vent and said vent breather means whereby a vacuum is formed in the spring side vacuum chamber providing a substantial resistance force acting against said spring slowing a closing speed of a door until said piston passes said vent breather means and atmospheric air is permitted to leak into the spring side vacuum chamber through said vent breather means gradually diminishing the vacuum in the spring side vacuum chamber resulting in a substantially uniform closing speed until said piston is adjacent said second end wall, whereby the combined effect of the pressure chamber and the spring side vacuum chamber results in smoother door closing.

7. A pneumatic door closer having a spring side vacuum chamber and a pressure chamber for smoother door closing as in claim 6 wherein:

said vacuum vent breather means comprises a hole in the wall of said elongated tube intermediate the first and second end of said elongated tube.

8. A pneumatic door closer having a spring side vacuum chamber and a pressure chamber for smoother door closing as in claim 6 wherein:

said vacuum vent breather means comprises a plurality of holes in the wall of said elongated tube intermediate the first and second end of said elongated tube.

9. A pneumatic door closer as defined in claim 1 wherein said breather means comprises a plurality of small port opening.

10. A pneumatic door closer having a spring side vacuum chamber and a pressure chamber for balancing closing forces providing a substantially uniform smooth door closing force comprising:

an elongated tube having a first end and a second end;

a first end wall placed in the first end, said first end wall having a piston rod opening;

a second end wall placed in the second end of said elongated tube;

a piston placed within said elongated tube dividing said elongated tube into the spring side vacuum chamber and the pressure chamber;

a piston rod attached to said piston and extending through the piston rod opening;

a seal placed in the piston rod opening around said piston rod at said first end wall, wherein said seal prevents air from escaping between the piston rod opening and said piston rod, a unidirectional piston sealing valve formed on said piston, whereby when said piston rod is drawn out of said elongated tube and said piston is moved towards said first end wall during opening of a door air flow is permitted into the pressure chamber and when said piston rod is drawn into said elongated tube during closing of the door and said piston is moved towards said second end wall air flow between the pressure chamber and the spring side vacuum chamber is prevented past the inner wall surface of said elongated tube;

a spring sealed within the spring side vacuum chamber in said elongated tube, wherein a bias of said spring forces said piston towards said second end wall;

a pressure vent communicating with the pressure chamber adjacent said second end wall, whereby said pressure vent controllably releases air pressure from the pressure chamber; and an orifice formed in said elongated tube and placed intermediate said first and second end wall selectively communicating with the spring side vacuum chamber and the pressure chamber depending upon a longitudinal position of said piston controllably permitting air to initially escape the pressure chamber and then enter the spring side vacuum chamber as said piston moves towards said second end wall, wherein when said piston rod is fully extended and said piston is between said first end wall and said orifice and said piston advances towards said second end wall a vacuum begins to be created in the spring side vacuum chamber and air in the pressure chamber is vented to atmosphere through both said pressure vent and said orifice whereby the vacuum formed in the spring side vacuum chamber provides a substantial resistance force acting against the bias of said spring slowing a closing speed of a door until said piston passes said orifice and atmospheric air is permitted to leak into the spring side vacuum chamber through said orifice gradually diminishing the vacuum and the substantial resistance force acting against the bias of said spring in the spring side vacuum chamber resulting in a substantially uniform closing speed until said piston is adjacent said second end wall, whereby the combined effect of a pressure differential caused by the pressure chamber and the spring side vacuum chamber in combination with said orifice results in smoother more uniform door closing forces applied by the pneumatic door closer in closing a door.

* * * * *